United States Patent [19]

Ward

[11] 4,368,775

[45] Jan. 18, 1983

[54] HYDRAULIC POWER EQUIPMENT

[76] Inventor: John D. Ward, 997 East Athens St., Altadena, Calif. 91001

[21] Appl. No.: 126,608

[22] Filed: Mar. 3, 1980

[51] Int. Cl.[3] ..... F28F 9/22

[52] U.S. Cl. ..... 165/1; 165/145; 165/163; 165/143; 165/104.28; 137/334; 60/456; 60/DIG. 5; 184/104 B

[58] Field of Search ..... 60/456, DIG. 5; 165/51, 165/143, 145, 163, 138, 1, 38, 104.28; 184/104 B; 62/DIG. 10; 123/41.33, 196 AB; 137/334, 339

[56] References Cited

U.S. PATENT DOCUMENTS

| | | | |
|---|---|---|---|
| 1,197,121 | 9/1916 | Herr | 60/DIG. 5 |
| 1,758,209 | 5/1930 | Wilson | 165/143 |
| 1,841,528 | 1/1932 | Gebhardt | 165/143 |
| 3,403,181 | 9/1968 | Painter et al. | 165/145 |
| 4,220,015 | 9/1980 | Johansing | 62/DIG. 10 |

FOREIGN PATENT DOCUMENTS

| | | | |
|---|---|---|---|
| 54-119119 | 9/1979 | Japan | 60/456 |

*Primary Examiner*—Albert W. Davis, Jr.
*Assistant Examiner*—Margaret A. Focarino
*Attorney, Agent, or Firm*—Benoit Law Corporation

[57] ABSTRACT

A liquid reservoir has a rectangular shell in which crossed first and second partitions form first, second, third and fourth rectangular liquid chambers. The partitions are impervious between the first and fourth chambers and apertured between the first and second, second and third, and third and fourth chambers. Liquid flows serially through the first, second, third and fourth chambers via the apertured partitions and such flowing liquid is subjected to a heat exchange in the first, second, third and fourth chambers.

10 Claims, 4 Drawing Figures

HYDRAULIC POWER EQUIPMENT

BACKGROUND OF THE INVENTION

1. Field of the Invention

The subject invention relates to hydraulic power plants and components therefor, to hydraulic power units, to hydraulic drives, tools and other equipment, to reservoirs, to methods and apparatus for providing hydraulic powers, to methods and apparatus for circulating a liquid in a reservoir, and to heat exchange techniques.

2. Disclosure Statement

This disclosure statement is made pursuant to the duty of disclosure imposed by law and formulated in 37 CFR 1.56(a). No representation is hereby made that information thus disclosed in fact constitutes prior art inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments subsequent in time or priority.

Hydraulic power units typically include one or more reservoirs for the hydraulic fluid which is moved by one or more pumps driven by an internal combustion engine, an electric motor or other suitable drive.

Existing hydraulic power units typically include automobile-type wheels carrying a heavy frame structure on which the motor and pump assembly are mounted apart from a reservoir facility and required accessories.

Some existing hydraulic power plants and units have been equipped with heat exchange facilities, typically for cooling the circulating hydraulic fluid. Sometimes water required for cooling a hydraulically actuated tool has been used for this purpose. Existing heat exchangers in this respect have tended to remain within the confines of established heat exchanger technology.

Reference may in this respect be had to U.S. Pat. No. 222,889, by J. B. Gathright, issued Dec. 23, 1879 for a faucet equipped with a helix immersible into a coolant, U.S. Pat. No. 745,499, by G. R. Jarman, issued Dec. 1, 1903 for a heat interchanger employing a double helix, U.S. Pat. No. 949,216, by A. C. Canida, issued Feb. 15, 1910 for a coil protector for coolers employing a helical tube immersed in ice, U.S. Pat. No. 1,424,689, by C. W. Stone, for an air cooler with bifilar helix, U.S. Pat. No. 1,813,667, by H. L. Hartenstein, issued July 7, 1931, for an apparatus for cooling internal combustion engines having a helical coil exposed to cool air, U.S. Pat. No. 2,077,846, by R. M. McIlvana, issued Apr. 20, 1937 for a milk cooler employing a bifilar cooling coil, U.S. Pat. No. 2,292,692, by O. R. Huber, issued Aug. 11, 1942, for a liquid refrigerating unit including helical and serpentine cooling coils, U.S. Pat. No. 2,449,127, by H. W. Kleist, issued Sept. 14, 1948 for an apparatus for cooling the interior of containers, employing bifilar and serpentine cooling coils, U.S. Pat. No. 2,752,763, by O. J. Shepard, issued July 3, 1956 for a beverage cooling apparatus with finned cooling coils or tubing, and U.S. Pat. No. 3,556,199, by R. S. De Groote, issued Jan. 19, 1971 for free convection cooling method and apparatus with immersed radiator-type heat exchanger.

One problem with a transfer of such heat exchange technology to the hydraulic power source area is that it is possible for hot hydraulic fluid to flow through the reservoir without being subjected to the desired cooling effect by heat exchanger means located therein.

In a similar vein, existing hydraulic power units have a reservoir capacity which typically is significantly higher than the volume of the hydraulic fluid pumped per minute. By way of example, a rule of thumb in this respect is that the reservoir capacity should be up to two and one-half times as high as the volume pumped per minute. This in practice adds considerable bulk and weight to hydraulic power units and also requires the volume of stand-by oil or other hydraulic fluid to be rather high. Yet despite such high reserves, existing power units often are not able to effect a sufficient or optimum cooling of the circulating hydraulic fluid. This eventuates shut-downs or limits power capacity and unit performance.

SUMMARY OF THE INVENTION

It is a general object of this invention to overcome the disadvantages and satisfy the needs expressed or implicit in the above disclosure statements or other parts hereof.

It is a related object of this invention to provide improved hydraulic power units.

It is a germane object of this invention to provide improved methods and apparatus for providing hydraulic power.

It is also an object of this invention to provide improved reservoirs.

It is a further object of this invention to provide improved methods and apparatus for circulating a liquid in a reservoir. It is a related object of this invention to provide improved heat exchanger methods and apparatus.

Other objects of this invention will become apparent in the further course of this disclosure.

From a first aspect thereof, the subject invention resides in a method of circulating a liquid in a reservoir and, more specifically, resides in the improvement comprising, in combination, the steps of providing a rectangular shell for said reservoir, providing first and second partition means to form with said shell a first rectangular chamber in a first corner region of the shell, a second rectangular chamber in a second corner region of the shell, a third rectangular chamber in a third corner region of the shell, and a fourth rectangular chamber in a fourth corner region of the shell and adjacent said first chamber, said partition means being made impervious between said first and fourth chambers and being apertured between said first and second, said second and third, and said third and fourth chambers, flowing the liquid serially through said first, second, third and fourth chambers via said apertured partition means, and subjecting said flowing liquid to a heat exchange in said first, second, third and fourth chambers.

From another aspect thereof, the subject invention resides in a method of providing hydraulic power and, more specifically, resides in the improvement comprising, in combination, the steps of providing a reservoir with n chambers for storing a hydraulic fluid, pumping said hydraulic fluid serially through said n chambers, and subjecting said hydraulic fluid to a heat exchange in said n chambers.

From another aspect thereof, the subject invention resides in a method of providing hydraulic power with a hydraulic fluid pump driven by a motor and, more specifically, resides in the improvement comprising, in combination, the steps of providing a hydraulic fluid reservoir as a mounting structure for said motor and pump, rendering mobile said reservoir, motor and pump by connecting carriage wheels to said reservoir, mounting said motor and pump on said reservoir, and connecting the pump to the reservoir.

From another aspect thereof, the subject invention resides in apparatus for circulating a liquid in a reservoir and, more specifically, resides in the improvement comprising, in combination, a plurality of n chambers in the reservoir for storing the liquid, an impervious partition between two of the n chambers, means connected to said chambers for flowing the liquid serially through said n chambers via said two chambers, and means in said chambers for subjecting said flowing liquid to a heat exchange in said n chambers.

From another aspect thereof, the subject invention resides in a liquid reservoir comprising, in combination, a rectangular shell, crossed first and second partition means forming with said shell a first rectangular chamber in a first corner region of the shell, a second rectangular chamber in a second corner region of the shell, a third rectangular chamber in a third corner region of the shell, and a fourth rectangular chamber in a fourth corner region of the shell and adjacent said first chamber, said partition means being impervious between said first and fourth chambers and being apertured between said first and second, said second and third, and said third and fourth chambers, means connected to said first and fourth chambers for flowing liquid serially through said first, second, third and fourth chambers via said apertured partition means, and means in said first, second, third and fourth chambers for subjecting said flowing liquid to a heat exchange in said chambers.

From another aspect thereof, the subject invention resides in a hydraulic power unit and, more specifically, resides in the improvement comprising, in combination, a hydraulic fluid pump and motor driving same, a hydraulic fluid reservoir interconnected with said pump and including a mounting structure for said motor and pump, and means for rendering mobile said reservoir, motor and pump, including carriage wheels connected to said reservoir.

BRIEF DESCRIPTION OF THE DRAWINGS

The invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
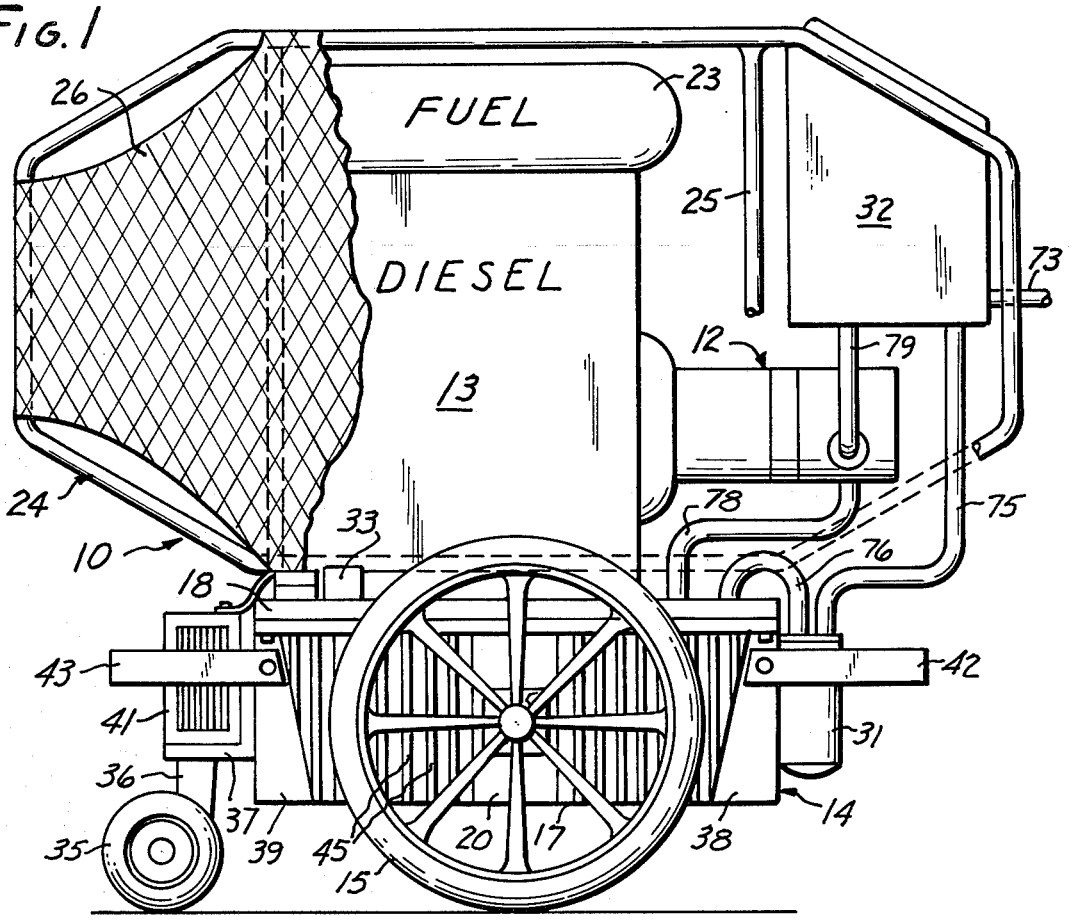
FIG. 1 is a side view of a mobile hydraulic power unit according to a preferred embodiment of the subject invention.
Figure 2:
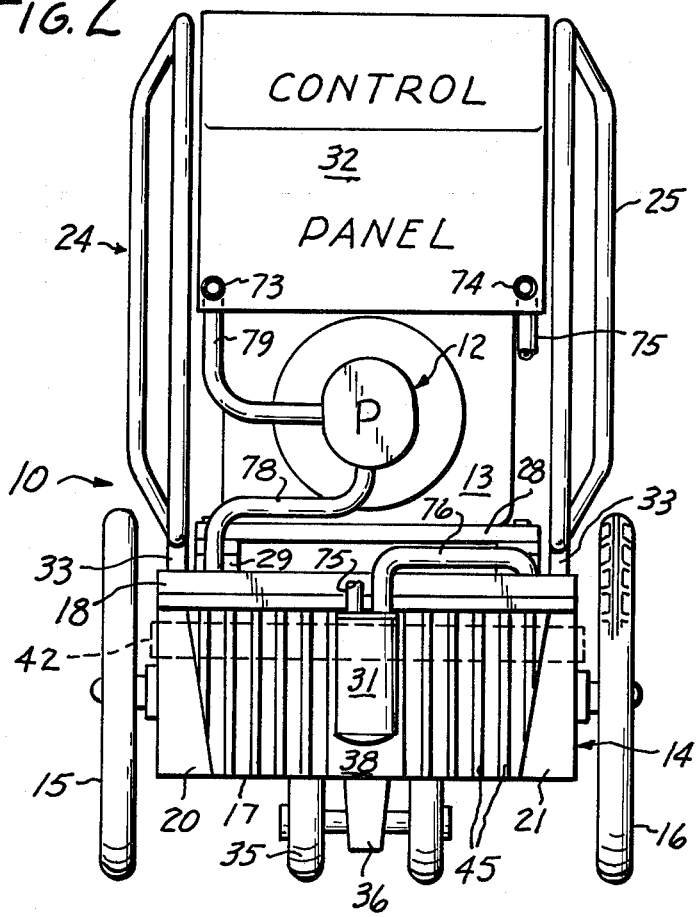
FIG. 2 is a front elevation of the hydraulic power unit of FIG. 1.

The mobile hydraulic power unit 10 according to the preferred embodiment of the subject invention shown in FIGS. 1 and 2, includes a hydraulic fluid pump assembly 12 and a motor or engine 13 driving same. A hydraulic fluid reservoir 14 is interconnected with the pump assembly 12 and includes a mounting structure for the motor and pump 12 and 13. According to the illustrated preferred embodiment of the subject invention, carriage wheels 15 and 16 are connected to the reservoir 14 for rendering mobile such reservoir, as well as the motor and pump 12 and 13. In short, the carriage wheels 15 and 16 are part of means for rendering mobile the reservoir 14, motor and pump 12 and 13, or generally the hydraulic power unit 10.

The illustrated power unit 10 thus embodies a method of providing hydraulic power with a hydraulic fluid pump assembly 12 driven by a motor 13. According to a preferred embodiment of the subject invention, this method comprises, in combination, the steps of providing a hydraulic fluid reservoir 14 as a mounting structure for the motor and pump 12 and 13, rendering mobile the reservoir, motor and pump by connecting carriage wheels 15 and 16 to the reservoir, mounting the motor and pump 12 and 13 on the reservoir as shown in FIGS. 1 and 2, and connecting the pump to the reservoir.

In practice, such construction and combination according to the illustrated preferred embodiment of the subject invention makes for hydraulic power units which are less bulky, lighter and less expensive than prior-art hydraulic power units of comparable performance and capacity.

Further according to an embodiment of the subject invention, the reservoir 14 includes or is formed as a mounting base for the motor and pump 12 and 13. This mounting base forms a structural part of the reservoir 14 on which the motor and pump are supported. The reservoir 14 with carriage wheels 15 and 16 thus is a chassis for the motor and pump 12 and 13.

By way of example, the reservoir 14 comprises or is formed as a shell 17 having a lid 18. It is then this reservoir lid 18 which constitutes or is formed as a mounting base for the motor and pump which are supported on such lid 18 as seen in FIGS. 1 and 2. In this respect, and within the scope of the subject invention, the pump or pump assembly 12 may, if desired, be mounted on the reservoir structure 14 or lid 18 separately from the engine 13. Alternatively, and as shown in FIGS. 1 and 2, the pump assembly 12 is mounted on the engine 13 and is thus supported or mounted on the reservoir structure 14 or lid 18 via the engine 13. In other words, motor and pump may be mounted as an assembly or unit on the reservoir structure or lid.

In the preferred embodiment shown in FIGS. 1 and 2, the carriage wheels 15 and 16 are attached to the shell 17 of the reservoir 14. In particular, the reservoir structure or shell has or is provided with lateral wheel mounting bases 20 and 21, which preferably are integral with or part of the reservoir structure or shell.

The carriage wheels 15 and 16 are attached to the wheel mounting bases laterally of the shell 17. In other words, the wheel mounting bases 20 and 21 carry the wheels 15 and 16 laterally of the reservoir shell 17 for rotation about an axis.

By way of example, the motor 13 may be a diesel or other internal combustion engine, and a fuel tank 23 may be supported by the reservoir structure 14 either directly, or as shown in FIG. 1, via the engine 13. Alternatively, an electric motor may be mounted on the reservoir structure for driving the pump assembly 12.

The reservoir 14 or lid 18 may carry further parts of the hydraulic unit 10, such as a lateral frame structure 24 including fabricated tubing 25 and screening 26 providing the unit in effect with appropriate protective side wall portions.

The motor and pump unit 12 and 13 is mounted on the reservoir lid 18 via a motor base 28 and blocks 29. Other accessories, such as a hydraulic oil filter 31, may be directly attached to the reservoir 14 or shell 17. Yet other accessories, such as a control panel 32, may be supported by the tubing 25. In this respect, the tubing 25 forms the frame 24 which is supported via blocks 33 on the lid 18 of the reservoir 14 which is of itself a mounting frame for the equipment 12, 13, 23 and 32, in accordance with the illustrated preferred embodiment of the subject invention.

In the preferred embodiment illustrated in FIGS. 1 and 2, the means for rendering the hydraulic unit mobile include one or more secondary or swivel wheels 35 in addition to the main carriage wheels 15 and 16.

By way of example, the secondary wheels 35 are mounted on a swivel 36 which is pivoted on a bracket 37 attached to the reservoir 14 or shell 17. In particular, the shell 17 may have fore and aft mounting bases 38 and 39 which preferably are integral with or a part of the reservoir shell 17. The hydraulic oil filter 31 is then attached to the front mounting base 38, while the swivel wheel bracket 37 is attached to the rear mounting base 39. The swivel bracket 37, in turn, may serve as a mounting base for further acessories, such as an electric battery or power source 41 for supplying, for instance, starting current for an electric starter associated with the engine 13.

The reservoir 14 and associated equipment may be protected by bumpers 42 and 43 attached to the reservoir shell 17 at the mounting bases 38 and 39, respectively.

Figure 4:
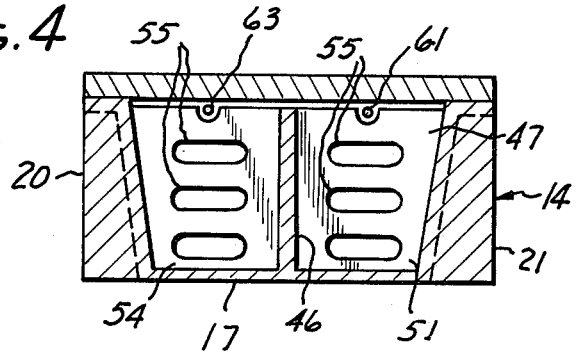
FIG. 4 is a view taken along the line 4—4 in FIG. 3.

According to the preferred embodiment of the subject invention shown in FIGS. 1 and 4, the reservoir 14 has a rectangular shell 17 which, by way of example, may be prismatic or, as shown in the drawings, may have the configuration of a truncated pyramid having a rectangular base. As seen in FIGS. 1, 2 and 4, lateral mounting bases 20, 21, 38 and 39 may be provided on or integral with the shell 17 in a cross pattern. Alternatively or additionally, a plurality of projecting ribs 45 may be provided along or across the walls of the reservoir shell 17. In practice, the projections 20, 21, 38, 39 and 45 provide the reservoir shell with structural strength and also constitute heat sinks and cooling fins with respect to hot oil circulating the reservoir 14. Structural strength is also provided by crossed partitions 46 and 47 which are particularly effective in supporting the reservoir walls when the hydraulic fluid is drawn out of the reservoir by the pump assembly 12. The reservoir 14 may thus be cast or molded inexpensively and with relatively thin walls of a light-weight material, such as aluminum or an aluminum alloy.

Figure 3:
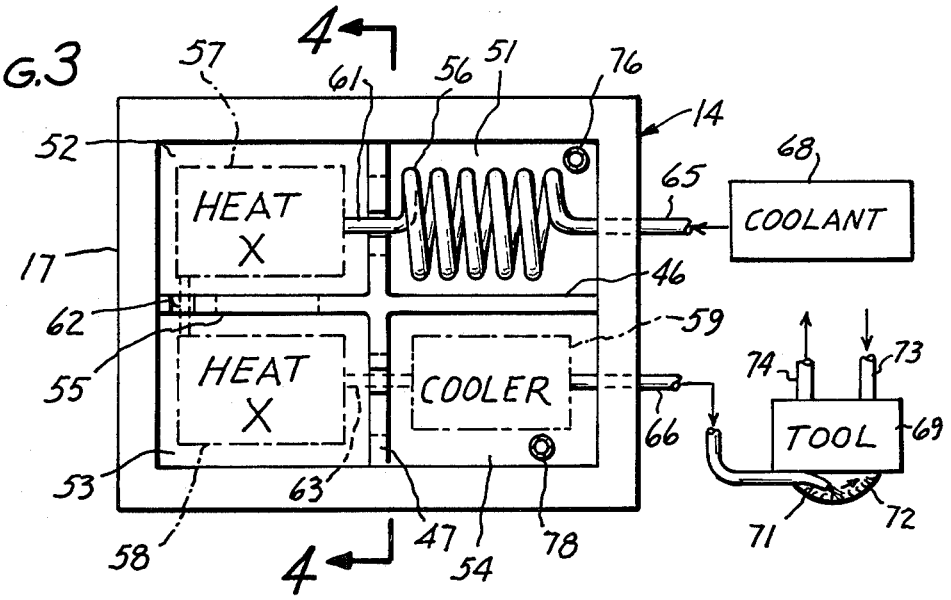
FIG. 3 is a plan view of a reservoir according to a preferred embodiment of the subject invention, and usable in the power unit of FIGS. 1 and 2.

As seen in FIGS. 3 and 4, crossed first and second partition means 46 and 47 form with the shell 17 a first rectangular chamber 51 in a first corner region of the shell, a second rectangular chamber 52 in a second region of the shell, a third rectangular chamber 53 in a third corner region of the shell, and a fourth rectangular chamber 54 in a fourth corner region of the shell 17 and adjacent the first chamber 51. The partition means 46 are impervious between the first and fourth chambers 51 and 54, but are apertured between the first and second chambers 51 and 52, the second and third chambers 52 and 53 and the third and fourth chambers 53 and 54, respectively. By way of example, apertures 55 are shown in FIG. 4 in solid lines in the partitions between the first and second and third and fourth chambers, while dotted lines in the partition between the second and third chambers indicate one or more apertures 55 in FIG. 3.

As more fully described below, liquid, such as a hydraulic fluid, is flown serially through the first, second, third and fourth chambers via the apertured partitions of the partition means 46 and 47. This liquid or hydraulic fluid is subjected to a heat exchange in the chambers 51, 52, 53 and 54.

In the illustrated preferred embodiment of FIG. 3, the heat exchange means thus provided include a first heat exchanger 56 in the first chamber 51, a second heat exchanger 57 in the second chamber 52, a third heat exchanger 58 in the third chamber 53 and a fourth heat exchanger 59 in the fourth chamber 54.

As seen at 56, helically wound tubing may be employed to provide the desired heat exchange means. On the other hand, other types of heat exchange elements may, if desired, be employed to provide the heat exchange means, as generally indicated by blocks at 57 to 59 in FIG. 3.

The heat exchangers 56 to 59 are connected in series, such as by tubing 61 to 63. If desired, the heat exchangers 56 through 59, including tubing 61 to 63, inlet tubing 65 and outlet tubing 66, may advantageously be formed of a single tube or of a couple of series-connected tubes.

As indicated at 59 in FIG. 3, the heat exchange means may be cooling means or coolers. In particular, a coolant, such as cold water, may be applied from a source or water outlet 68 to the inlet tubing 65, to be serially circulated through the first, second, third and fourth heat exchangers 56 to 59, so as to remove heat from, or lower the temperature of, hydraulic fluid in the chambers 51 to 54 of the reservoir 14. The heat exchange or cooling medium supplied by the source 68 preferably may be a coolant for the tool 69 which is driven by hydraulic fluid from the unit 10. In that case, the hydraulic fluid in the reservoir 14 is cooled by the coolant for the tool 69.

The currently discussed method of operating a hydraulic tool 69 thus stores a hydraulic fluid in a reservoir 14, circulates the hydraulic fluid through the reservoir 14 and tool 69 for driving such tool, supplies to the tool 69 a further fluid, such as cold water from the source 68, having a temperature difference relative to the hydraulic fluid in the reservoir 14, and effects a heat exchange between such further fluid and the hydraulic fluid.

As seen in FIG. 3, the further fluid, which may be cold water or another coolant for the tool 69, may after circulation through the heat exchangers 56 to 59 in reservoir chambers 51 to 54, be applied by a spray nozzle or similar outlet 71 to a rotary blade 72 or other active portion of the tool 69 which heats up during operation thereof.

Hydraulic fluid for driving the hydraulic tool 69 is applied thereto through a supply line 73, to be subsequently removed therefrom through a return line 74. In practice, the supply and return lines 73 and 74 may include piping, tubing, hoses or combinations thereof, as desired or necessary for a given tool or task.

As seen in FIG. 2, the return line 74 enters the hydraulic unit, such as at the control panel 32, to be applied to the oil filter 31 via a line 75. A line 76 applies the filtered oil or hydraulic fluid to the reservoir 14 and thus constitutes a reservoir inlet leading into the first chamber 51. Because of the imperforate nature of the partition 46 between the first and fourth chambers 51 and 54, the hydraulic fluid entering the reservoir 14 cannot immediately depart from the reservoir through its outlet 78, largely in circumvention of the heat exchanger or cooling means 56 to 59. Rather, the imperforate nature of the latter partition in effect forces the hydraulic fluid to flow serially through all chambers 51 to 54 via apertures 56, in heat exchange relationship with all heat exchangers 56 to 59.

In the illustrated preferred embodiment, all portions of the circulating hydraulic fluid are thus subjected to a full cooling cycle. In the embodiment shown in FIGS. 1 and 2, the reservoir hydraulic fluid outlet is part of a line 78 connected to an inlet of the pump assembly 12. Hydraulic fluid is thus drawn into the reservoir 14 via return lines 73 and 75 and, after circulation through all chambers 51 to 54, is pumped out of the reservoir via line 74, to be applied to the hydraulic fluid supply line 73 via an internal line 79. Hydraulic fluid is thus circulated through a closed circuit including pump assembly 12, reservoir 14, and lines 73 and 74, thereby driving the active part of the tool 72.

In practice, the pump assembly 12 may include more than one pump driven by the engine or motor 13. For instance, the assembly 12 may include two pumps which may be operated singly, alternatively, in parallel or in series as far as the delivery of hydraulic fluid from or through the reservoir is concerned, in order to operate two or more hydraulic tools via two or more sets of supply and return lines at the same time, or in order to operate larger, as well as smaller hydraulic tools as desired or required for a given task. In addition to instruments for indicating hydraulic pressure and other operating parameters, the control panel may thus include manually operated valves for switching various pump and fluid line combinations.

By way of background and as indicated above, the rule of thumb heretofore was that reservoir capacity should significantly exceed pump volume per minute of a hydraulic power unit. In particular, a widely used rule dictated a reservoir capacity of two and a half times hydraulic fluid volume pumped per minute.

Because of the features of the subject invention herein disclosed, the capacity of the reservoir 15 may in practice be significantly lower than the hydraulic fluid pumped per minute. By way of example, a prototype of the hydraulic power unit shown in FIGS. 1 to 4 is able to pump 20 gallons per minute with a reservoir capacity of only 12 gallons; that is, of only 60% pump capacity, as contrasted to the 250% of the above mentioned rule of thumb.

The latter prototype according to the subject invention is capable of delivering hydraulic oil at a pressure of 1,500 to 1,700 pounds per square inch. Because of the heat exchange or cooling system and compartmentalization of the reservoir shown in FIG. 3, such prototype working with tap water as a coolant is able to cool the above mentioned circulating oil from 140° F. at the input line 76 to room temperature at the supply line 73.

To These and similar ends, the subject invention provides methods and apparatus for circulating a liquid in a reservoir 14 by providing a plurality of n chambers 51 et seq. in the reservoir for storing the liquid, providing an impervious partition 46 between two chambers 51 and 54 of the n chambers, flowing the liquid serially through the n chambers via the mentioned two chambers 51 and 54 and subjecting this flowing liquid to a heat exchanger in the n chambers.

The reservoir 14 is in effect subdivided into n chambers, whereby the n chambers actually constitute subdivisions of the reservoir 14. Apertured partitions 47 are provided between one of the two chambers 51 and 54 and a third of the n chambers, and between that third chamber and the other of the two chambers 51 and 54. It is thus within the broad contemplation of the subject invention that the regions 52 and 54 shown in FIG. 3 may be implemented in the form of one third chamber in addition to the two mentioned chambers 51 and 54.

However, for larger pumping capacities or cooling effects, it is preferable to provide at least the four chambers 51 and 54 and to aperture the partitions 46 and 47, but only between one of the two chambers 51 and 54 and a third chamber 52 of the n chambers, between such third chamber 52 and a fourth chamber 53 of the n chambers, and between a fourth chamber 53 and the other chamber 54 of the mentioned two chambers 51 and 54. Suitable partition apertures have been shown at 55 in FIGS. 3 and 4.

As seen in FIG. 3, the desired heat exchange or cooling is effected successively in the n chambers 51 to 54, while liquid is flown from one of the two chambers 51 serially through n-2 chambers to the other of the two chambers 54.

As diagrammatically illustrated in FIG. 3, the pumped hydraulic fluid may drive a hydraulic tool 69 requiring a further operating fluid having a temperature difference relative to the hydraulic fluid. The desired heat exchange in the n chambers 51 to 54 may then be effected with the further operating fluid supplied from the source 68 via heat exchangers 56 to 59 and spray nozzle 71.

The subject extensive disclosure renders apparent or suggest to those skilled in the art various modifications and variations within the spirit and scope of the invention.

I claim:

1. In a method of circulating a liquid in a reservoir, the improvement comprising in combination the steps of:

providing a rectangular shell for said reservoir;

providing first and second partition means to form with said shell a first rectangular chamber in a first corner region of the shell, a second rectangular chamber in a second corner region of the shell, a third rectangular chamber in a third corner region of the shell, and a fourth rectangular chamber in a fourth corner region of the shell and adjacent said first chamber, said partition means being made impervious between said first and fourth chambers and being apertured between said first and second, said second and third, and said third and fourth chambers;

flowing the liquid serially through said first, second, third and fourth chambers via said apertured partition means; and subjecting said flowing liquid to a heat exchange in said first, second, third and fourth chambers.

2. A method as claimed in claim 1, wherein:

said reservoir is configured as a truncated pyramid having a rectangular base.

3. A method as claimed in claim 1, wherein:

said heat exchange is effected successively in said first, second, third and fourth chambers.

4. A method as claimed in claim 1, wherein:

said heat exchange is a cooling of said liquid in said first, second, third and fourth chambers.

5. A method as claimed in claim 1, 2, 3 or 4, wherein:

said heat exchange includes the step of circulating a coolant through conduits in said first, second, third and fourth chambers.

6. A liquid reservoir comprising in combination:

a rectangular shell;

crossed first and second partition means forming with said shell a first rectangular chamber in a first corner region of the shell, a second rectangular chamber in a second corner region of the shell, a third rectangular chamber in a third corner region of the shell, and a fourth rectangular chamber in a fourth corner region of the shell and adjacent said first chamber;

said partition means being impervious between said first and fourth chambers and being apertured between said first and second, said second and third, and said third and fourth chambers;

means connected to said first and fourth chambers for flowing liquid serially through said first, second, third and fourth chambers via said apertured partition means; and means in said first, second, third and fourth chambers for subjecting said flowing liquid to a heat exchange in said chambers.

7. A reservoir as claimed in claim 6, wherein:

said shell has the configuration of a truncated pyramid having a rectangular base.

8. A reservoir as claimed in claim 6, wherein:

said heat exchange means include a first heat exchanger in said first chamber, a second heat exchanger in said second chamber, a third heat exchanger in said third chamber, and a fourth heat exchanger in said fourth chamber.

9. A reservoir as claimed in claim 8, wherein:

said heat exchange means include means for connecting said first, second, third and fourth heat exchangers in series.

10. A reservoir as claimed in claim 8 or 9, wherein:

said heat exchange means include means for circulating a coolant through said first, second, third and fourth heat exchangers.

* * * * *